US005442991A

United States Patent [19]

Swann et al.

[11] Patent Number: 5,442,991

[45] Date of Patent: Aug. 22, 1995

[54] ACCUMULATING ROTARY TRANSFER UNIT

[75] Inventors: Lynn J. Swann, La Verne; Larry D. Wedertz, Mira Loma; Michael D. Golden, Laguna, all of Calif.

[73] Assignee: Hughes Missile Systems Company, Los Angeles, Calif.

[21] Appl. No.: 558,077

[22] Filed: Dec. 5, 1983

[51] Int. Cl.[6] ..... F41A 9/02

[52] U.S. Cl. ..... 89/33.1; 89/33.4; 89/33.5

[58] Field of Search ..... 89/33.14, 33.1, 33.5, 89/33.4, 33.01, 34

[56] References Cited

U.S. PATENT DOCUMENTS

| | | | |
|---|---|---|---|
| 332,741 | 12/1885 | Palmer | 89/33.01 X |
| 1,297,699 | 3/1919 | Krzyzanowski | 89/33.01 X |
| 2,367,572 | 1/1945 | Gazda | 89/34 |
| 2,521,346 | 9/1950 | D'Assis-Fonseca | 89/33.5 |
| 3,333,507 | 8/1967 | Meiss | 89/34 |
| 3,427,923 | 2/1969 | Meyer et al. | 89/33.02 |
| 3,437,005 | 4/1969 | Trumper | 89/33.02 |
| 3,498,178 | 3/1970 | Meyer et al. | 89/34 |
| 3,590,684 | 7/1971 | Gilbert | 89/34 |
| 3,687,004 | 8/1972 | Faisandier | 89/33.02 |
| 3,974,738 | 8/1976 | Meyer | 89/34 |
| 4,004,490 | 1/1977 | Dix et al. | 89/39 X |
| 4,064,786 | 12/1977 | Elwin | 89/33.1 |
| 4,166,408 | 9/1979 | Wetzel et al. | 89/34 X |
| 4,344,350 | 8/1982 | Golden | 89/33.5 |
| 4,492,144 | 1/1985 | Dix | 89/33.14 X |

*Primary Examiner*—Stephen C. Bentley

*Attorney, Agent, or Firm*—Charles D. Brown; Randall M. Heald; Wanda K. Denson-Low

[57] ABSTRACT

A device for use in a rapid-fire weapons system wherein a gun is movable in both elevation and azimuth. The device is designed to have a high round storage capacity and transfers rounds across the azimuth axis, thus allowing the gun to move in azimuth with respect to the magazine. The storage, or accumulation, feature of the device allows rounds to be fed to the gun before the magazine has been driven to the demand rate.

The device also provides a closed loop round carrier system which allows for the return of expended round casings to the magazine.

47 Claims, 3 Drawing Sheets

ACCUMULATING ROTARY TRANSFER UNIT

The Government has rights in this invention pursuant to Contract No. N00024-80-C-7016, awarded by the U. S. Navy.

BACKGROUND OF THE INVENTION

1. Field of the Invention

The present invention relates to apparatus for the reorientation of a plurality of serially supplied items. More particularly, the presently disclosed apparatus is directed to the reorientation of ammunition rounds being fed from a stationary magazine to a gun which is variable in the azimuth axis, the apparatus also functioning as a round accumulator during gun start-up and shut-down.

2. Description of the Prior Art

Rapid-fire weapon systems available in the prior art have problems inherent in their operation. In general, the firing weapon is in a gun mount or turret located at one part of the weapons system and the magazine supply for ammunition rounds is located separately. One problem in this arrangement is that mere separation of the weapon and magazine is troublesome. For example, the length of the supply line between the magazine and the weapon can be so great that the pulling force of the weapon may be insufficient to draw the rounds from the magazine container due to the conveyor length and, hence, the weight of the conveyor along the supply path.

The prior art has dealt with the conveyor length problem by providing means for driving either the magazine or the conveyor at a rate comparable to the weapon demand rate. High power is required to overcome the inertia of the magazine when the magazine is driven in conjunction with the demand rate of the weapon. Since the firing weapon demand rate varies abruptly, depending on whether the firing mechanism is held on or released, rather complex systems are needed to bring the magazine first to a high feed rate and then to bring it to rest after the gun shuts down.

While prior art solutions to the problem of feeding a rapid-fire gun are acceptable in certain application installations, their use with a rapid-fire weapon movable in elevation and azimuth planes, for example, has presented additional unresolved difficulties. In typical weapon applications, individual rounds from the magazine are transported to the gun mount by some type of conveyor or other rounds carrier, usually contained within a flexible chute. These flexible chutes commonly are capable of motion in both elevation and azimuth planes. The chute contortions dictated by required elevation and azimuth angles for proper gun mount flexibility result in ever changing dynamic conditions in the ammunition, chutes and conveyors. This in turn has resulted in increased weapon reliability problems, because flexible chutes have a number of inherent deficiencies, particularly being prone to jamming.

The system of Meyer U.S. Pat. No. 3,974,738 sought to overcome these prior art deficiencies with a device that has a fixed, non-flexible chute connected between the input side of the device and the output of the magazine. The fixed, non-flexible chute and associated conveyor bring individual rounds from a conventional storage magazine to the entrance of the device. The device has its entrance anchored to a fixed structure. The output end of the device is designed to rotate with the weapon or weapon mount, and thus the chute need be movable only in the elevation plane of the weapon.

The device includes storage means and a differential for transferring rounds in the storage means. The differential adds and subtracts velocities to match the input velocity to the device and the output velocity from the device to the required weapon feed rate. By utilizing the storage capacity within the device, the weapon is permitted to fire at full rate without requiring the magazine to match this rate in phase with the weapon.

A number of techniques have been disclosed in the prior art for feeding rounds from the magazine to a gun secured to a movable mount. In particular the following patents illustrate the scope of the available art in this area: U.S. Pat. Nos. 332,741, 1,297,699, 2,367,572, 2,521,346, 3,333,507, 3,427,923, 3,437,005, 3,498,178, 3,590,684, 3,687,004, 4,004,490, 4,064,786, 4,166,408 and 4,344,350.

Although the aforementioned patents describe various improvements for feeding ammunition to a gun as the gun mount in which the gun is secured rotates in the elevational and/or azimuth directions, each of these patents still has limitations associated therewith which preclude their use as a complete solution to the present need. Referring to U.S. Pat. No. 3,974,738, in particular, the system disclosed therein requires a powered drive for adjusting rounds within the system with the attendant increase in system complexity and possibility of misfire. Further, the rounds are oriented in a horizontal attitude as they are moved about within the storage reservoir which decreases the storage capacity of the reservoir while increasing the physical size thereof. Further, the upper and lower transfer wheels are limited in their rotational capability, thus limiting the storage capacity of the reservoir. Finally, the system in U.S. Pat. No. 3,974,738 does not return expended shell casings to the magazine but ejects the casings, which is not suitable in the present application.

What is therefore desired is a device for use in weapons systems which has a relatively large storage capacity and which transfers the ammunition rounds from a magazine to the weapon in a rapid and efficient manner such that the weapon is allowed to fire at rapid rates as the magazine is brought up to the required firing speed. It would also be desirable if the device is configured to return expended shell casings to the round magazine or to some other storage magazine.

SUMMARY OF THE INVENTION

In brief, arrangements in accordance with the present invention comprise a rotary transfer device for transferring ammunition (rounds) from a sprocket associated with a stationary magazine to a sprocket which moves with the gun in an azimuth direction. The device also functions as an accumulator during gun start-up and shut down and allows the gun mount to move by a limited extent in an azimuth direction without requiring the magazine to run. The device comprises a toroidal shaped, cylindrical housing, having an input sprocket and an outer round guide fixed in position with respect to the magazine. The input sprocket transfers ammunition rounds to an outer round carrier while the outer round guide provides radial control to the rounds on the outer carrier member. Travelling in the feed direction, the outer round carrier transports the rounds to a transfer sprocket located within the cylindrical housing for transferring the rounds to an inner round carrier. The transfer sprocket is geared to both inner and outer round carriers and is mounted on a center round guide. Thus the transfer sprocket transfers rounds from the outer round carrier to the inner round carrier, the center round guide providing radial control to the rounds on the inner and outer round carriers. The inner round carrier in turn transports rounds from the transfer sprocket to an output sprocket. The output sprocket and the inner round guide are mounted to follow the azimuth position of the gun mount. Lead-in and outlet channels direct the ammunition to and from the transfer device.

The device of the present invention functions to transfer ammunition rounds across the azimuth axis to allow the gun to move in azimuth with respect to the stationary magazine and also provides for accumulation, or storage, to allow ammunition rounds to be fed to the gun before the magazine is supplying rounds at the full rate. In the situation with the gun firing and the magazine rotating, the input sprocket supplies rounds to the outer carrier which transports the rounds to the transfer sprocket. At the transfer sprocket, ammunition is transferred to the inner round carrier which moves the rounds to the output sprocket. All interconnected elements in the mechanism are geared together. As the gun mount rotates in the azimuth direction, the output sprocket moves with the gun mount. This motion causes the inner round carrier to be driven faster (for rotation in one direction), which drives the transfer sprocket faster. The outer round carrier and the input sprocket are driven at the rate of the magazine feed. If there is a mismatch in speed between the inner and outer round carriers, the transfer sprocket is caused to move with the center mount guide. When the inner carrier runs faster (i.e., clockwise rotation of the mount or with the gun firing with the magazine stopped), the transfer sprocket will move toward the input and output sprockets. When the inner carrier runs slower (counterclockwise rotation of the gun mount or the gun stopped with the magazine running) the transfer sprocket will move away from the input and output sprockets. The motion of the transfer sprocket away from and toward the input and output sprockets provides the accumulation function by lengthening and shortening the round paths, respectively. The position of the transfer sprocket relative the output sprocket is sensed to provide a differential signal to activate a magazine drive motor. The motor will be driven in the forward or reverse direction as required to keep the transfer sprocket in the desired position.

In the null position (demand rate equal to magazine feed rate) the accumulated rounds occupy approximately 180° of the toroidal housing. The other half of the housing may include a corresponding set of elements which functions in the same manner to return the spent shell casings or misfired rounds to the magazine.

DESCRIPTION OF THE DRAWING

A better understanding of the present invention may be had from a consideration of the following detailed description, taken in conjunction with the the accompanying drawings in which.

DESCRIPTION OF THE PREFERRED EMBODIMENT

Figure 1:
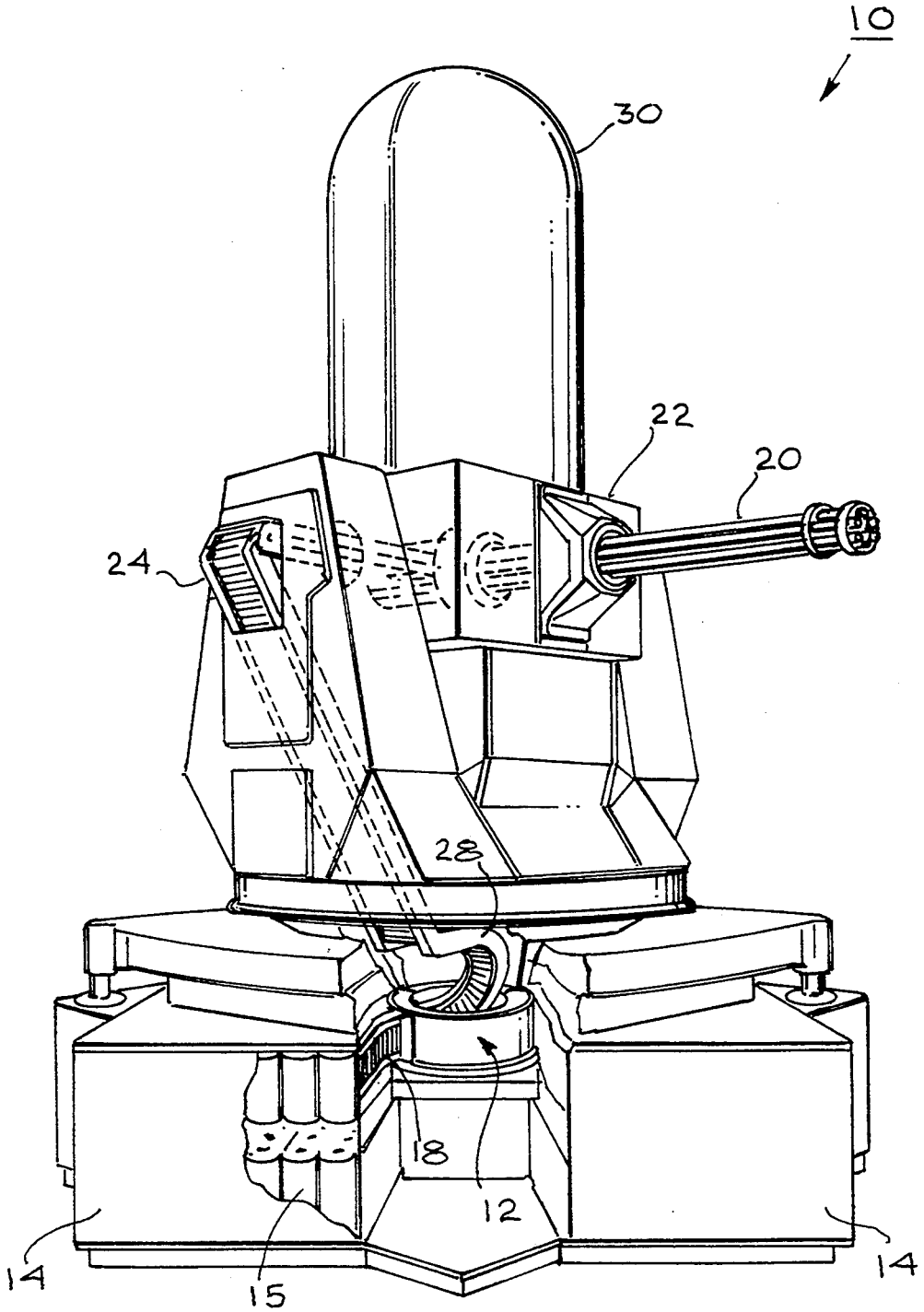
FIG. 1 is a perspective view of a weapons system in which the novel transfer and accumulating rotary transfer unit of the present invention can be utilized.

Referring now to FIG. 1, reference numeral 12 indicates the accumulating rotary transfer device of the present invention illustratively shown as forming a part of weapon system 10. Weapon system 10 includes a magazine 14 coupled to the unit 12 via a transfer chute 18. A rapid fire weapon 20 is mounted in a gun turret 22 for movement in elevation and in azimuth. A chain ladder 24 is utilized to transport the ammunition rounds from the azimuth axis accumulating rotary transfer device 12 to the gun 20. A radar system for tracking an incoming target is incorporated in radome 30. The endless chain ladder 24 returns the spent shell casings to magazine 14 via the unit 12. The chain ladder travels within the magazine 14 along reciprocating paths defined by guides 15. The outer housing of the unit 12 is mounted to the stationary magazine 14. A central portion of unit 12 is rotatable with the turret 22.

Except for the unit 12, the weapons system depicted in FIG. 1 corresponds to the Phalanx close-in weapon system currently installed on Navy ships to provide a last-ditch defense against Antiship Missiles. The Phalanx system, as presently in use, has been demonstrated to be very effective, firing 20 mm. shells at a rate of firing in excess of 3000 rounds per minute. In place of the accumulating rotary transfer unit 12 of the present invention, present systems utilize a rotary drum for storing ammunition rounds between the magazine and the gun. The drum stores approximately 900 rounds and is mounted on the rotational gun mount and must be power driven. Substitution of the rotary transfer unit 12 of the present invention, which is supported on the stationary base rather than the rotary gun mount, thus reduces by approximately 1000 pounds the weight of the rotary gun mount and substantially reduces the power which is required to drive the system of FIG. 1.

Figure 2:
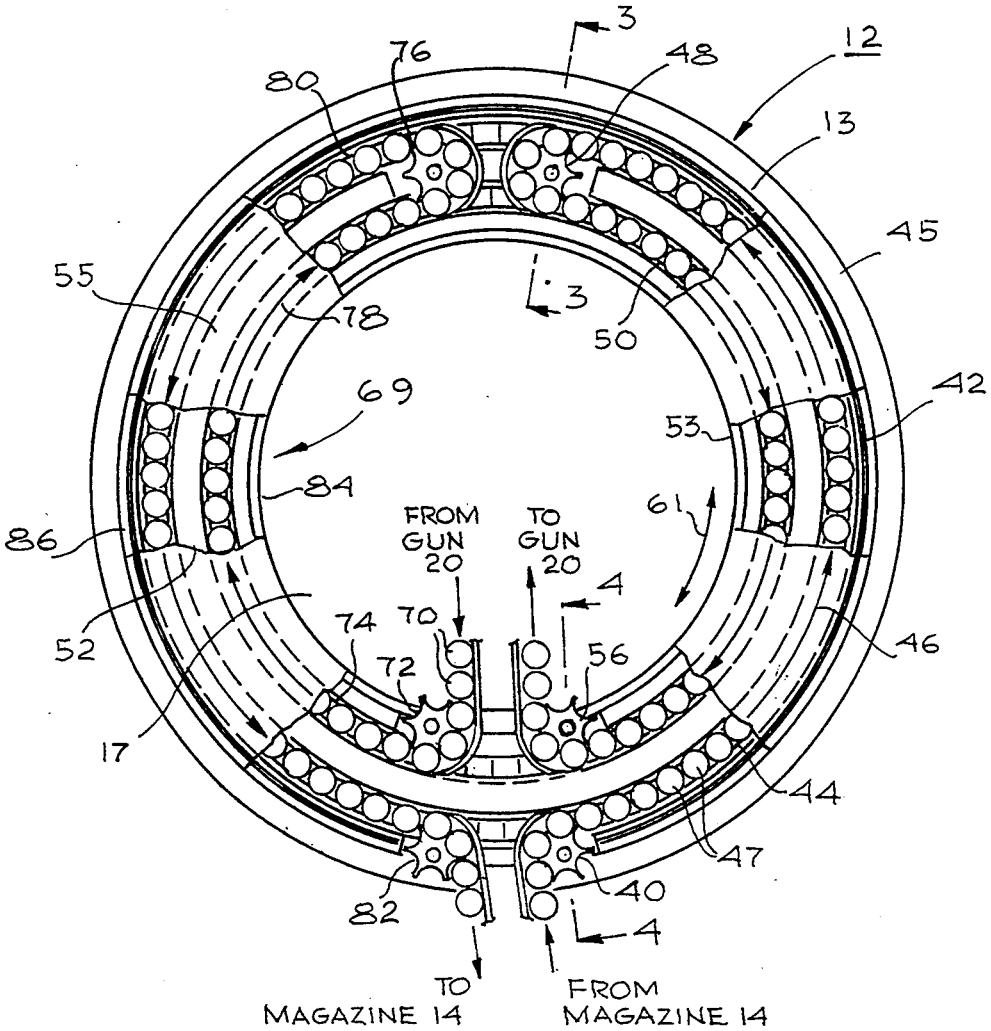
FIG. 2 is a plan view with portions cut away showing the accumulating rotary transfer unit of the present invention.
Figure 3:
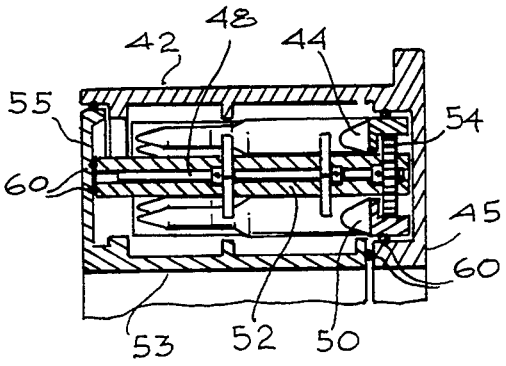
FIG. 3 is a sectional view along line 3—3 of FIG. 2.
Figure 4:
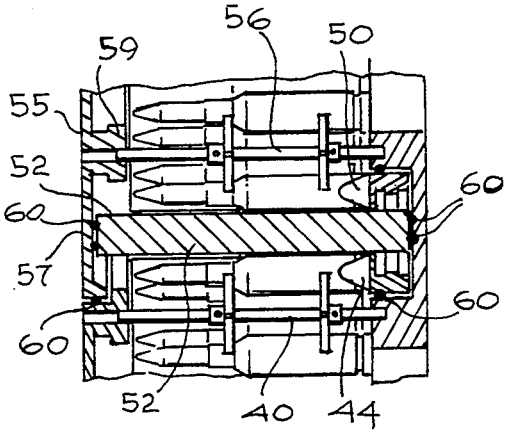
FIG. 4 is a sectional view along line 4—4 of FIG. 2.

Referring now to FIGS. 2 and 4, the positions of input sprocket 40 within toroidal shaped cylindrical housing 13 (portion 17 is hollow) and an outer round guide 42 are fixed with respect to magazine 14 shown in FIG. 1. The ammunition rounds 47 are held in a vertical attitude within the cylindrical housing 13. Input sprocket 40 transfers rounds of ammunition to the outer round carrier 44. The outer round guide 42 provides radial control for the rounds on the outer carrier. The outer round carrier 44 is geared to the input sprocket 40. Travelling in the feed direction, indicated by the reference arrow 46, the outer round carrier 44 transports ammunition rounds 47 to a transfer sprocket 48. The transfer sprocket 48 is geared to both the inner round carrier 50 and the outer round carrier 44 via gear 54 and is mounted on the center round guide 52 as shown in FIG. 3. The transfer sprocket 48 transfers ammunition rounds from the outer round carrier 44 to the inner round carrier 50. The rotatable center round guide 52 provides radial control to the rounds on the inner and outer round carriers 50 and 44, respectively. The inner round carrier 50 transports rounds from the transfer sprocket 48 to the output sprocket 56. The inner round carrier 50 is geared to the output sprocket 56 via a gearing arrangement (not shown). The location of the output sprocket 56 and inner round guide 53 moves in the azimuth direction as indicated by arrow 61 as the gun mount 22 moves in the azimuth direction. Inner round guide 53 (and thus output sprocket 56) is fixedly mounted to gun turret 22 by top plate 55.

The accumulating rotary transfer unit 12 of the present invention performs two basic functions: (1) it transfers ammunition rounds in a continuous manner across the azimuth axis, thus allowing gun 20 to move in the azimuth with respect to the magazine 14, and (2) it provides storage or accumulation, thus allowing ammunition rounds to be fed to gun 20 before the magazine is up to full rate of firing. Device 12 performs the function as follows; with the gun 20 firing and magazine 14 running, the input sprocket 40, which is caused to rotate by the gearing arrangement, deploys ammunition rounds to the outer carrier 44 which transports the rounds to the transfer sprocket 48. At the transfer sprocket 48, ammunition rounds are transferred to the inner round carrier 50 which transports the rounds back to the output sprocket 56. All the elements in the unit are geared together. As the gun mount 22 moves in azimuth, portion 57 of inner guide 53 and output sprocket 56 move with the gun mount 22, sprocket 56 being coupled to guide portion 57 at 59.

Since inner round guide 53 is geared to inner round carrier 50, the motion in turn causes the inner round carrier 50 to be driven faster, which then drives the transfer sprocket 48 at a faster rate. The outer round carrier 44 and the input sprocket 40, the former fixedly connected at bottom plate 45, are driven at the rate of the magazine 14. If there is a mismatch in speed between the inner and outer round carriers, the transfer sprocket 48 will be moved appropriately to compensate for this mismatch. In particular, when the inner round carrier 50 runs faster (clockwise rotation of gun mount 22 or the gun 20 firing with the magazine 14 stopped), transfer sprocket 48 will move toward the sprockets 40 and 56. When the inner carrier 50 runs slower (counterclockwise rotation of the gun mount 22 or if the gun 20 is not firing but with the magazine running), the transfer sprocket 48 will move away from the input sprocket 40 and output sprocket 56. This motion of the transfer sprocket 40 away from or towards the input/output sprockets provides the accumulation function by lengthening or shortening the path of the ammunition. Consequently, reduced power is required to accelerate the magazine 14 upon initiation of weapon operation. A plurality of bearings 60 are provided in the system as illustrated.

In accordance with a further aspect of the present invention, device 12 includes a mechanism 69 for returning empty casings from the gun 20 to the magazine 14 which is identical to the mechanism described hereinabove for transferring rounds from magazine 14 to gun 20. In particular, and referring to the left-hand portion of FIG. 2, the casings 70 returning from gun 20 are taken up by input sprocket 72 and positioned in inner casing carrier 74. Carrier 74 carries the casings 70 to transfer sprocket 76 in the direction of arrow 78, sprocket 76 in turn transferring the casings to outer casing carrier 80. Carrier 80 then carries the casings to output sprocket 82 from which the casings are transferred to magazine 14. Inner casing guide 84 and outer casing guide 86 are provided to guide and control the position of the casings as they are transferred from the gun 20 to the magazine 14. Note that the center round guide 52 is the only component common to both mechanisms and that the movement of transfer sprocket 76 corresponds to the movement of transfer sprocket 48. Ladder 24 acts as the common bridge between the transfer mechanism 12 and the return mechanism 69.

Figure 5:
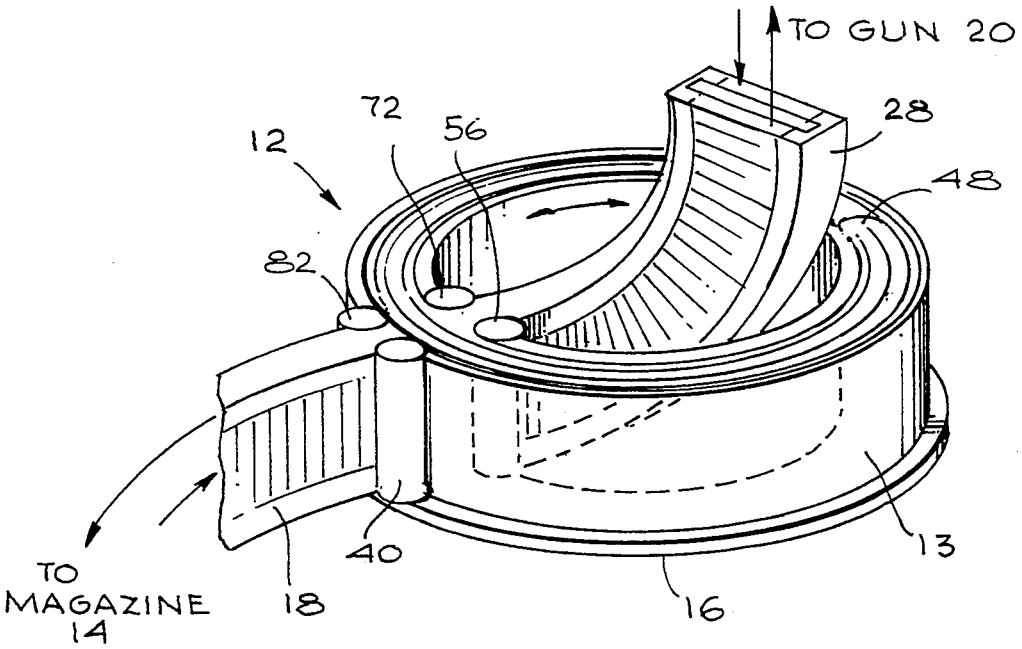
FIG. 5 is a schematic view of a portion of the transfer unit of FIG. 2, particularly showing the lead-in and outlet channels for transporting ammunition into and out of the transfer unit.

FIG. 5 shows the transfer unit 12 having housing 13 terminating in a peripheral circumferential skirt 16 for mounting the unit. Transfer chute 18 for transporting ammunition from the magazine 14 and returning spent shell casings thereto is coupled to the periphery of the stationary housing 13. Another chute 28 is provided to transfer ammunition from the transfer unit to the gun 20 and to return spent shell casings to the unit 12. The chute 28 is affixed to the central plate 17 for rotation with the gun 20.

Figure 6:
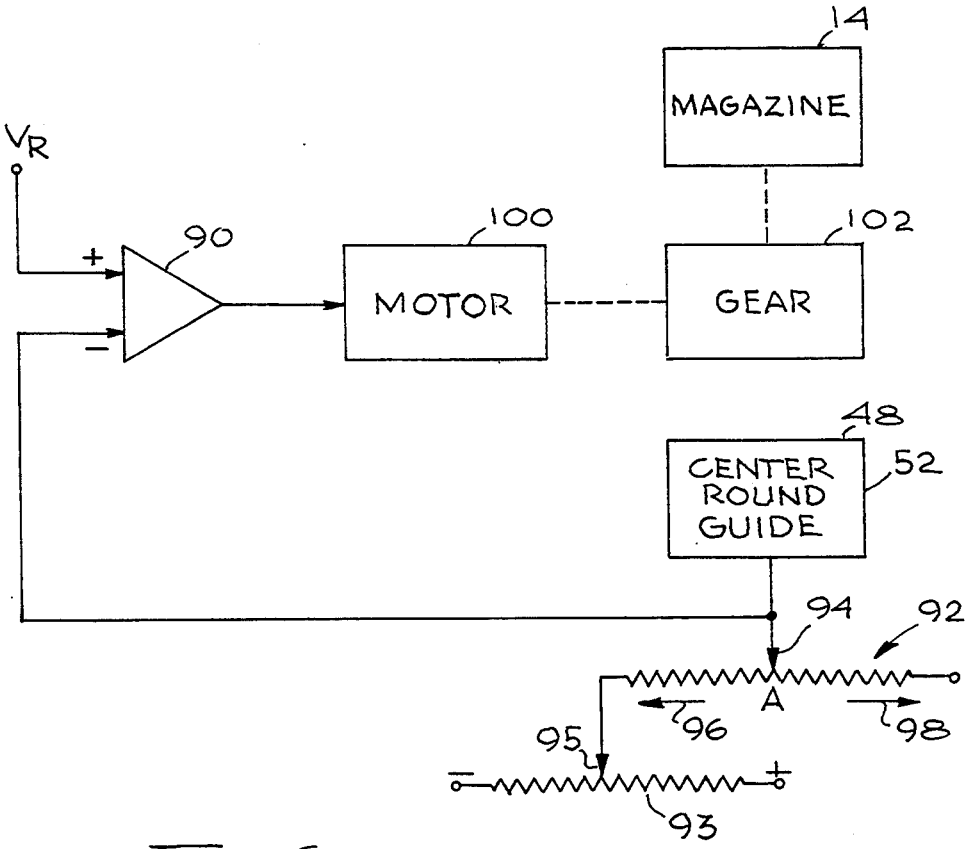
FIG. 6 is a schematic block diagram illustrating the magazine control system.

FIG. 6 illustrates, in block diagram form, a control circuit for restoring the transfer sprocket 48 to the desired, or null, position after the transfer sprocket 48 and center round guide 52 have been moved to accommodate different firing situations as set forth hereinabove. The null position is established by voltage $V_R$ applied to one terminal of servoamplifier 90. A linear potentiometer 92, the movable arm 94 of which is mounted on the center round guide 52, determines when the center guide (and transfer sprocket 48) is off the neutral, or null position A. In the neutral position the output voltage at movable arm 94, fed back to the other input of servoamplifier 90, is equal to $V_R$. Thus, the output of servoamplifier 90 is substantially zero. If the arm 94 is moves in the direction of arrow 96, corresponding to the situation when transfer sprocket 48 is caused to move towards sprockets 40 and 56, a differential signal is applied to servoamplifier 90. The resulting output signal (positive sense) is coupled to reversible servomotor 100 which, via gear means 102, drives magazine 14 in the forward direction, such that magazine 14 supplies the excess number of rounds to device 12. The center round guide 52 overshoots the null position as it moves to accommodate gun 20 but is repositioned to its null position when the demand rate, determined by the gun firing rate, and the supply rate, determined by the magazine 14, are equal.

Similarly, if the arm 94 moves in the direction of arrow 98, corresponding to the situation where transfer sprocket 48 is caused to move away from sprockets 40 and 56, a differential signal is applied to servoamplifier 90, an output signal thus being generated. This signal (negative sense) is coupled to servomotor 100 which, via gear means 102, drives magazine 14 in the reverse direction such that magazine 14 takes the excess rounds stored by device 12. The center round guide 52 (and sprocket 48) is returned to its null position when the demand rate equals the supply rate.

In summary, when the input ammunition flow is equal to output demand, the input sprocket 40 is rotating at the speed of output sprocket 56. Consequently, there is no translation of the center round guide 52 or the transfer sprocket 48.

Where weapon 20 demand is greater than the rate of supply from the magazine, the transfer sprocket 48 moves in the clockwise direction, taking rounds from the outer round carrier 44 at a higher rate than they are being fed in and thereby depleting both the outer round carrier 44 and the inner round carrier 50. In the instance where demand is less than the supply rate, the opposite action occurs. That is, transfer sprocket 48 is rotated counterclockwise, filling both the inner round carrier 50 and the outer round carrier 44.

Where flow in the magazine is equal to the weapon 20 demand but the turret 22 is moving clockwise or to the left in the diagrammatic illustration as shown, turret 22 motion in the azimuth plane effects a response similar to that for the greater demand rate situation. The transfer sprocket 48 location temporarily moves relative to the output sprocket 56 because the output sprocket 56 is fixed to the moving structure of the turret. A second linear potentiometer 93 is provided to sense gun turret rotation and cause the first potentiometer 92 with arm 94 to develop a new null signal for the servo system. Arm 95 of potentiometer 93 moves in azimuth with the turret 92 and is connected to one end of the potentiometer 92. Thus any deviation from the center position of arm 95 of potentiometer 93, due to rotation of the turret, produces a change of potential across potentiometer 92 with a resulting change in the null position signal applied to differential amplifier 90 from arm 94. Thus the magazine 14 is driven accordingly to compensate for turret rotation, as well as for changes in demand for ammunition due to firing of the gun. Azimuth movement of the turret 22 in the clockwise direction moves the output sprocket 56 away from the transfer sprocket 48 which in turn moves to a new null position. Therefore, for a fixed output rate, the inner carrier 50 rotation generated by the turret 22 rotation clockwise causes transfer sprocket 48 to reduce the number of rounds in the outer round carrier 44.

When the turret moves to the right (counterclockwise), the opposite occurs; that is, the output sprocket 56 is moved toward the transfer sprocket 48. To accommodate this apparent reduction in demand, the transfer sprocket 48 moves counterclockwise to a new null position and draws additional rounds into the outer round carrier 44. Movement of the rounds between the inner and outer round carriers 44 and 50 is possible because dead space is provided in each carrier for this contingency. That is, not all positions available for storage of the rounds in the inner and outer carrier guides are utilized in the normal operating range of device 12. These additional spaces are available to accommodate the rounds transfer between the inner and outer carrier guides during azimuth plane movement of the turret 22.

Power to the device 12 is derived from two sources, a weapon drive motor and a magazine drive motor, neither of which is illustrated in the diagram. The accumulation principle of the device 12 automatically provides for major compensation between gun demand and magazine feed rate during weapon firing, acceleration and shut down as well as during rotation of the turret. The transfer sprocket 48 senses the deviations between the rotational speed of the outer round carrier 40 as established by the feed rate of the magazine and the speed of the inner round carrier 44 as determined by the firing rate demand. The transfer sprocket 48 seeks an azimuthal position proportional to the inner and outer carrier speed difference and transfers rounds from the outer round carrier 44 to the inner round carrier 50 and hence to the weapon 20 at the proportional speed. In effect, the complement of rounds in device 12 is depleted or added to as required to accommodate firing start-up or termination.

Since the part of the unit handling the spent shell casings for return to the magazine operates in the same manner as the section for handling ammunition rounds as just described, the same type of compensation is provided for variations in ammunition demand rates. The same center round guide 52 is operative on both sides of the unit, serving to extend the path for spent shell casings or misfired rounds within the unit when the length of the path for the ammunition rounds going to the gun is reduced, as is the case when the rate of firing exceeds the rate of supply from the magazine. As the rate of supply catches up, or if the gun stops firing, the inner round guide 52 and attendant transfer sprockets 48, 76 move in the opposite direction (counterclockwise), thereby lengthening the path for the ammunition rounds and shortening the path for the spent shell casings or misfired rounds.

The present invention thus provides a simplified mechanical device for use in a rapid-fire weapons system wherein the possibilities of misfire and/or firing jams are significantly reduced. Since the device is designed to transfer rounds from the magazine to the gun while the rounds are positioned vertically with respect to the azimuth plane and since the internal rounds carrier can be rotated in a range much greater than heretofore available, the capacity of the device to handle/transfer rounds is greatly increased. Another feature of the invention is that provision is made for the return of expended shell casings to the magazine, thus eliminating the costs and hazards involved in ejecting empty rounds such that they cannot be recovered or must be picked up manually.

The accumulating rotary transfer unit of the present invention thus performs a very important function in providing ammunition to a rapidfire gun, such as the Gatling gun used in the Phalanx close-in weapon system for shipboard installation. Such a weapon fires at a rate of 3000 rounds per minute, or better. In the Phalanx system, when the gun begins firing it accelerates within a fraction of a second to full demand rate. There are approximately 4000 rounds of ammunition in the feed path from magazine to weapon and the weight of these rounds (nearly 3000 pounds) presents a substantial inertial load to the feed mechanism. Present Phalanx weapon systems utilize a rotary, power-driven drum, mounted at the output of the magazine at the base of the gun turret, but this requires substantial power to bring the ammunition train up to the speed of the gun within a reasonable response time. The accumulating rotary transfer unit of the present invention substantially reduces the power requirements of the system by permitting the ammunition train between the magazine and the gun to come up to speed more gradually.

Although there have been described above specific arrangements of an accumulating rotary transfer unit in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. Accumulating rotary transfer apparatus for storing and transferring ammunition between a stationary magazine and a weapon which is rotatable in azimuth direction, the apparatus comprising:

a housing having an inner center portion which is rotatable in azimuth direction with the weapon and an outer circumferential portion which is stationary relative to the magazine;

a pair of concentric circular carriers for transporting ammunition rounds within the housing;

means for rotating the carriers about a central axis in opposite directions relative to each other;

means for transferring rounds in sequence from one carrier to the other during transfer of ammunition through the housing; and means for feeding ammunition rounds into the housing to one of the carriers and out of the housing from the other carrier during transfer of ammunition through the housing.

2. The apparatus of claim 1 wherein the feeding means are operable independently of each other in accordance with respective demand and supply rates of the weapon and the magazine, respectively.

3. The apparatus of claim 1 further including means for supporting the transferring means between the two carriers, said supporting means being rotatable with the transferring means about said axis.

4. The apparatus of claim 3 wherein the supporting means comprises a curved round guide extending between the two carriers for guiding the ammunition rounds on the carriers.

5. The apparatus of claim 4 wherein the curved guide comprises a curved vertical wall extending along the major part of a circle between the two carriers.

6. The apparatus of claim 1 wherein the center portion comprises an inner round guide positioned adjacent and radially inward from the inner one of said carriers for guiding ammunition rounds thereon.

7. The apparatus of claim 6 wherein the inner round guide comprises a vertical wall of generally circular configuration extending substantially about the major portion of a circle within the housing.

8. The apparatus of claim 6 wherein the inner round guide is mounted for rotation with the inner central portion of the housing.

9. The apparatus of claim 6 wherein the outer portion comprises an outer round guide positioned adjacent and radially outward from the outer one of said carriers for guiding ammunition rounds thereon.

10. The apparatus of claim 9 wherein the outer round guide comprises a vertical wall of generally circular configuration extending substantially about the major portion of a circle within the housing.

11. The apparatus of claim 9 wherein the outer round guide is fixed relative to the outer circumferential portion of the housing.

12. The apparatus of claim 9 wherein the outer round guide comprises the outer circumferential portion of the housing.

13. The apparatus of claim 9 further including a center round guide for cooperating with both the inner and outer round guides in guiding the ammunition rounds on the respective carriers.

14. The apparatus of claim 13 wherein the center round guide comprises a generally vertical wall extending substantially about the major part of a circle between the two carriers.

15. The apparatus of claim 13 wherein the center round guide is rotatable between the carriers about said axis.

16. The apparatus of claim 14 wherein the supporting means is coupled for movement with the curved round guide.

17. The apparatus of claim 16 wherein the supporting means is mounted on the curved round guide.

18. The apparatus of claim 1 wherein the transferring means comprises a sprocket which is rotatable about a vertical axis for engaging the ammunition rounds in succession and transporting them about said vertical axis to transfer each round from one carrier to the other.

19. The apparatus of claim 1 wherein the transferring means comprises a sprocket having means operative to transfer ammunition rounds in succession from one carrier to the other as the carriers move in opposite directions relative to each other.

20. The apparatus of claim 1 wherein the transferring means comprises a sprocket having means operative to transfer the ammunition rounds in succession from one carrier to the other while one of the carriers is stationary.

21. The apparatus of claim 1 wherein the transferring means comprises a sprocket having means operative to transfer the ammunition rounds in succession from one carrier to the other while the inner one of said carriers is stationary.

22. The apparatus of claim 1 wherein the transferring means comprises sprocket having means operative to transfer the ammunition rounds in succession from one carrier to the other while the outer one of said carriers is stationary.

23. The apparatus of claim 18 further including a guide member mounted adjacent the transferring means for cooperating with the rotatable sprocket to engage each round individually and permit movement of each round past the guide member about the sprocket axis.

24. The apparatus of claim 23 wherein the guide member is movable with the transferring means about the central axis.

25. The apparatus of claim 1 wherein the ammunition round feeding means comprise an outer sprocket and an inner sprocket, each being rotatable about a vertical axis and having an adjacent guide member for cooperating with the associated sprocket to engage each round individually and permit movement past the guide member about the sprocket axis.

26. The apparatus of claim 25 wherein the outer sprocket is mounted in a stationary position adjacent the outer carrier.

27. The apparatus of claim 26 wherein the outer sprocket is geared to the outer carrier for driving the outer sprocket and outer carrier in synchronism.

28. The apparatus of claim 25 wherein the inner sprocket is coupled to the inner center portion for rotation in azimuth direction with the weapon.

29. The apparatus of claim 28 wherein the inner sprocket is mounted adjacent the inner carrier and is geared thereto for driving the inner sprocket and the inner carrier in synchronism.

30. The apparatus of claim 1 including means for moving the transferring means through nearly a full circle about the central axis in varying the extent of the path of the ammunition rounds through the unit,

31. The apparatus of claim 1 including means for moving the transferring means about the central axis from a position adjacent one of the ammunition round feeding means on one side thereof to a position adjacent said one feeding means on the other side thereof.

32. The apparatus of claim 1 further including means for defining a path for the ammunition rounds through the housing.

33. The apparatus of claim 32 further including means for varying the length of said path within the housing in accordance with the firing rate of the weapon relative to the delivery rate from the magazine.

34. The apparatus of claim 32 further including means for varying the length of said path within the housing in accordance with the rotation of the weapon in azimuth direction.

35. The apparatus of claim 1 wherein the ammunition rounds are transported within the housing in a substantially vertical attitude.

36. The apparatus of claim 9 wherein the outer round guide comprises a generally vertical circumferential wall affixed to a generally planar, radially extending base portion of the housing.

37. The apparatus of claim 36 wherein the inner round guide comprises a generally vertical circumferential wall supported by bearings on said base portion.

38. The apparatus of claim 37 further including a center round guide comprising a generally vertical circumferential wall supported by bearings between a generally planar, radially extending cover portion of the inner guide and the base portion of the housing.

39. The apparatus of claim 38 wherein the center guide supports the transferring means for movement therewith about the central axis.

40. The apparatus of claim 1 further including means for feeding empty shell casings and misfired rounds into the housing to one of the carriers and out of the housing from the other carrier and means for transferring said shell casings in sequence from one carrier to the other during the transfer of both ammunition and shell casings through the housing, said pair of carriers being effective for transporting said shell casings and misfired rounds within the housing.

41. The apparatus of claim 40 further including means for defining dual paths of variable path length within the housing, one path being for ammunition rounds and the other path being for spent shell casings and misfired rounds.

42. The apparatus of claim 41 further including means for varying the lengths of said paths within the housing, the length of the ammunition round path being varied inversely to the length of the path for the shell casings and misfired rounds.

43. The apparatus of claim 42 wherein the means for feeding the ammunition rounds and the means for feeding the shell casings comprise respective pairs of inner and outer sprockets mounted back to back and being adjacent an associated one of the carriers.

44. Accumulating rotary transfer apparatus for storing and transferring ammunition between a stationary magazine and a weapon which is rotatable in azimuth direction, the apparatus comprising:

a generally cylindrical housing having a base portion, an outer circumferential wall portion comprising an outer guide member and defining a central axis, a plurality of bearing situated between the base portion and the outer wall portion, and a cover portion remote from the base portion and including an inner center portion which is rotatable in azimuth direction with the weapon;

an inner round guide comprising a generally vertical wall and part of said cover portion and supported for rotation about the center axis by said bearings situated between the inner guide and the base portion and outer wall, respectively;

a center round guide mounted on bearings between the base portion and the cover portion for rotation about the central axis independent of the outer wall and the inner guide for defining a variable path length for ammunition being transported through the housing; and a pair of ammunition round carriers, an inner carrier being positioned between the inner guide and the center round guide for rotation about the central axis and an outer carrier being positioned between the center round guide and the outer wall for rotation about the central axis.

45. The apparatus of claim 44 further including means movable with the center round guide for transferring rounds from one carrier to the other.

46. Accumulating rotary transfer apparatus for storing and transferring ammunition between a stationary magazine and a weapon which is rotatable in azimuth direction, the apparatus comprising:

a housing having an inner center portion which is rotatable in azimuth direction with the weapon and an outer circumferential portion which is stationary relative to the magazine;

a pair of concentric inner and outer circular carriers rotatable about a central axis of the housing for transporting ammunition rounds with a generally vertical orientation within the housing;

a first sprocket coupled to drive the outer carrier of said pair i in transferring ammunition rounds between said outer carrier and the magazine, said sprocket being rotatable about a vertical axis;

a second sprocket coupled to drive the inner carrier of said pair for transferring ammunition rounds between said inner carrier and the weapon, said second sprocket being rotatable about a vertical axis; and means for transferring ammunition rounds in sequence from one carrier to the other.

47. The apparatus of claim 46 including means for moving said transferring means about the central axis to vary the path length and the number of the ammunition rounds within the housing.

* * * * *